US007651975B2

(12) United States Patent
Date et al.

(10) Patent No.: US 7,651,975 B2
(45) Date of Patent: Jan. 26, 2010

(54) HEAT-SENSITIVE RECORDING MATERIAL

(75) Inventors: Takashi Date, Tokyo (JP); Junpei Natsui, Tokyo (JP); Yoshimi Midorikawa, Tokyo (JP); Tatsuo Nagai, Tokyo (JP); Yoshihide Kimura, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 320 days.

(21) Appl. No.: 10/551,675

(22) PCT Filed: Mar. 31, 2004

(86) PCT No.: PCT/JP2004/004667

§ 371 (c)(1),
(2), (4) Date: Sep. 29, 2005

(87) PCT Pub. No.: WO2004/087433

PCT Pub. Date: Oct. 14, 2004

(65) Prior Publication Data

US 2006/0191433 A1 Aug. 31, 2006

(30) Foreign Application Priority Data

Mar. 31, 2003 (JP) ..... 2003-095944
Jun. 18, 2003 (JP) ..... 2003-174132
Sep. 26, 2003 (JP) ..... 2003-335594

(51) Int. Cl.
*B41M 5/337* (2006.01)

(52) U.S. Cl. ..... 503/207; 503/215

(58) Field of Classification Search ..... None
See application file for complete search history.

(56) References Cited

U.S. PATENT DOCUMENTS 2,900,348 A 8/1959 Ahlberg et al.
4,977,133 A * 12/1990 Ishida et al. ..... 503/226

FOREIGN PATENT DOCUMENTS

| | | | |
|---|---|---|---|
| EP | 0 326 964 | A2 | 1/1989 |
| EP | 1 080 940 | A2 | 3/2001 |
| JP | 55-159993 | | 12/1980 |
| JP | 03-47699 | | 1/1987 |
| JP | 04-55127 | | 1/1987 |
| JP | 09-207435 | | 8/1997 |
| JP | 09-266711 | | 10/1997 |
| JP | 10-258577 | | 9/1998 |
| JP | 2002-301873 | | 10/2002 |
| WO | WO 97/16420 | A1 | 5/1997 |
| WO | WO 00/15552 | A1 | 3/2000 |
| WO | WO 02/081229 | A1 | 10/2002 |

* cited by examiner

*Primary Examiner*—Bruce H Hess
(74) *Attorney, Agent, or Firm*—Flynn, Thiel, Boutell & Tanis, P.C.

(57) ABSTRACT

The present invention is a thermally sensitive recording medium containing a thermally sensitive color developing layer containing a colorless or pale colored basic leuco dye and a color-developing agent as the main components on a substrate, wherein the thermally sensitive recording layer contains an acrylic polymer obtained by the copolymerization of an alkyl acrylate, alkyl methacrylate and vinylsilane as monomer components and a colloidal. Further, the present invention is a thermally sensitive recording medium, wherein the colloidal silica possesses a chain structure.

4 Claims, No Drawings

HEAT-SENSITIVE RECORDING MATERIAL

FIELD OF THE INVENTION

The present invention relates to a thermally sensitive recording medium which utilizes a color developing reaction of a colorless or pale colored basic leuco dye with a color developing agent and, in particular, relates to a thermally sensitive recording medium to which a water-resistant property fitted for outdoor use, such as a handy terminal paper or a delivery slip, is provided.

BACKGROUND OF THE INVENTION

In general, a thermally sensitive recording medium which obtains a recorded image utilizing a color developing reaction by the heating of a colorless or pale colored basic leuco dye with a color developing agent has advantages that the coloring is very clear, noiseless during the recording process and the equipment is relatively cheap, compact and maintenance free, and is widely applied in the field of a facsimile, a computer field and a recorder for various measuring instruments. Further, currently, a use as an output medium for various printers or plotters such as a handy terminal for outdoor measurement or a delivery slip, besides a use for a label or a ticket, are rapidly expanding. These usages are characterized in being often used outdoors, therefore, qualities and property characteristics for being used under a more serious environment than conventional uses, for example, water and high humidity caused by rain, sunshine or high temperatures in a car during midsummer season. Furthermore, it is necessary to provide a good printing aptitude in these different uses, especially, when used as a delivery slip, a good seal-ability is an important quality.

Regarding an improvement in water-resistance, for example, in patent document 1, a method of adding an isocyanate compound to an adhesive such as polyvinylalcohol is disclosed. In the meanwhile, a method to improve the water-resistance by using a hydrophobic resin emulsion such as a vinyl acetate emulsion, acrylic emulsion or SBR latex as an adhesive for a thermally sensitive layer is known, however, since these methods have a problem of causing the accumulation of dregs on a head or sticking during the recording process, actual use has not been sufficiently accomplished yet. Further, a method of using a composite of colloidal silica and an acrylic polymer as an adhesive is proposed in patent document 2 and a method of using a self-crosslinkable acrylic emulsion and colloidal silica is proposed in patent document 3. However, these methods cannot achieve a water-resistance satisfying outdoor use and the problem of accumulation of dregs on a head is not suppressed sufficiently.

[Patent Document 1] JP-A-S55-159993 publication

[Patent Document 2] JP-A-H09-207435 publication

[Patent Document 3] JP-A-H09-266711 publication

In patent document 4, a water-resistant coating composition prepared by blending colloidal silica with an aqueous emulsion containing a copolymer obtained by the emulsion-polymerization of a vinylsilane and an acrylic monomer is disclosed.

[Patent Document 4] JP-B-H03-47699 publication

DISCLOSURE OF THE INVENTION

The object of the present invention is to provide a thermally sensitive recording medium which has an excellent water-resistance and good printing aptitude, and is characterized by less accumulation of dregs on a head and providing a good seal-ability.

In the present invention, the above-mentioned object is obtained by a thermally sensitive recording medium comprising a thermally sensitive color developing layer containing a colorless or pale colored basic leuco dye and a color developing agent as main components on a substrate, wherein said thermally sensitive recording layer comprises an acrylic polymer obtained by the copolymerization of an alkyl acrylate, an alkyl methacrylate and a vinylsilane as monomer components and a colloidal silica possessing a chain structure, or, contains an acrylic polymer obtained by the copolymerization of at least an acrylic alkyl, a methacrylic alkyl and a vinylsilane and colloidal silica possessing a chain structure.

Further, in the present invention, it is effective that said acrylic polymer contains acrylonitrile and/or styrene as a monomer component.

DESCRIPTION OF THE PREFERRED EMBODIMENT

The thermally sensitive recording medium of the present invention can be obtained, for example, by mixing a dispersion prepared by dispersing a basic leuco dye color developing agent with a binder, a dispersion prepared by dispersing a color developing agent with a binder, an acrylic polymer, a colloidal silica possessing a chain structure, a filler and other necessary additives to prepare a coating for a thermally sensitive layer, coating it on a substrate and drying it to form a thermally sensitive layer.

Regarding the colloidal silica used in the present invention, its form is not restricted, however, a spherical type prepared by dispersing ultra fine particles of silicic anhydride in water or a chain-type possessing structural features characterized by specific numbers of spherical colloidal silica, which are primary particles, are linked in linear or partial grafting and form a rosary are desirably used. They can be used alone or in combination. The average particle size of the primary particles of spherical colloidal silica or chain colloidal silica is desirably 5-50 nm and the average particle size is desirably within the range of from 5 to 50 to the average particle size of 100 of the acrylic polymer particle. While, the size (length) of the chain colloidal silica as measured by a laser scattering method is desirably 40-200 nm, and when the size is too small, since the void fraction becomes low, a sufficient effect of reducing dregs accumulated on a thermal head and providing desired water-resistance cannot be obtained and the desirable lower limit is 40 nm. Further, from the view point of stability of coating, anionic colloidal silica is suitable, therefore the desirable pH of the colloidal solution is approximately 7-11.

In particular, chain colloidal silica is preferably used in the present invention. The reason why an excellent effect is obtained in the present invention is not clear, however, the reason can be guessed as follows. That is, the heat resistance of the acrylic polymer is low and easily fused by the heat at the printing process and causes the accumulation of dregs on a head. However, when contained together with colloidal silica in a thermally sensitive recording layer, the colloidal silica surrounds the acrylic polymer particles (hereinafter shortened to "acrylic particles") and obstruct the transmitting of heat to the acrylic particles effectively and the accumulation of dregs on a head is protected. In the present invention, the fusion of the acrylic particles becomes more difficult because the heat sealing effect is enhanced by forming voids around the acrylic particles based on the three-dimensional structure formed at the bonding process of the colloidal silica with the acrylic particles.

On the contrary, in a case when the acrylic particles are fused, it is considered that the fused product is absorbed into voids formed by using chain colloidal silica and the formation of dregs on a head is remarkably controlled. The void-forming function by the chain colloidal silica improves concurrently an absorbency and a preserving ability of an inkpad ink which contributes to seal-ability.

Further, by increasing the void fraction in a thermally sensitive recording layer, a pseudo layer of air protects the permeation of water. Further said chain structure entangles properly and becomes more insoluble in water so that higher water resistance is provided.

As a chain colloidal silica to be used in the present invention, a chain colloidal silica disclosed in international publication WO 00/15552 is desirable. That is, this product consists of spherical colloidal silica particles with an average particle size of 10-80 nm and a metal oxide containing silica which bond said spherical colloidal silica particles, and D1/D2, which is the ratio of particle size (D1 nm), as measured by the dynamic light scattering method, and the average particle size of spherical colloidal silica D2 nm (the measured particle size D2 nm by the nitrogen absorbing method (BET method)), is 3 or more, wherein said D1 is 50-500 nm and it is desirable to use a dispersion of chain colloidal silica particles characterized in that spherical colloidal silica particles are linked in one plane and dispersed in a liquid medium to form stable silica sol of 1-50 wt % $SiO_2$ concentration.

Said chain colloidal silica can be obtained by the following (a), (b), (c) and (d) processes.

The colloidal aqueous solution of activated silicic acid used in the (a) process is a solution in which silicic acid and polymer particles of silicic acid, whose particle size is 3 nm or less, coexist and can be prepared easily by a conventional method. A desirable aqueous colloidal solution of activated silicic acid can be obtained by cation exchange treatment of water-soluble silicate, for example, a diluted aqueous solution of water glass $SiO_2/M_2O$ (wherein M indicates an alkali metal atom and O indicates an oxygen atom) molar ratio is 2-4. In general, a colloidal solution containing 0.5-5 wt % of solids and whose pH value is 6 or less, desirably 2-6 is used. Further, this pH value can be easily adjusted by the partially remaining cations at the cation exchange process of said aqueous solution of water glass, or after removing all or a part of the cations, by adding a small amount of alkali metal hydroxide or water-soluble organic base to obtain a colloidal aqueous solution of activated silicic acid. Since the colloidal aqueous solution of activated silicic acid is unstable and has a tendency to easily gelate, it is desirable to use it immediately after its preparation. As long as the desired silica sol is obtainable, the colloidal aqueous solution of activated silicic acid can contain other components and, further, can contain small amounts of cations and anions.

(a) The particle size of acidic silica sol having an average particle size of 3-8 nm is difficult to be measured by a nitrogen absorbing method and, in general, the SHIARS method is used.

According to a nitrogen absorbing method, the silica sol is dried and the specific surface area is measured by a nitrogen absorbing method, however, when the average particle size is small, since the colloidal silica particles bond to each other and the specific surface area becomes small, it becomes difficult to measure the true value. The SHIARS method is a SHIARS titration method disclosed in page 1981 of Analytical Chemistry vol. 28, No. 12 (1956), and the true value can be measured because it is measured in the liquid state.

This acidic silica sol, whose average particle size is 3-8 nm, $SiO_2$ concentration is 0.5-10 wt % and pH is 2-6, can be a product prepared by a conventional method, for example, by methods disclosed in the U.S. Pat. No. 268,071 B publication, U.S. Pat. No. 2,900,348 publication or JPH4-55127B publication, and when the D1/D3 ratio, wherein D1 is the measured particle size value by a dynamic light scattering method and D3 is the measured particle size value by the SHIARS method, is less than 5, the shape of the colloidal silica particles can be spherical or not spherical. However, for the purpose of obtaining a homogeneous chain silica sol, it is desirable to use a spherical silica sol having a small particle size measured by a dynamic light scattering method. This acidic silica sol can be obtained by a cation exchange process and the pH value can be easily adjusted by the partially remaining cations at the cation exchange process of said aqueous solution of water glass, or after removing all or a part of the cations, by adding a small amount of an alkali metal hydroxide or water-soluble organic base to obtain a colloidal aqueous solution of activated silicic acid. As said acidic silica sol, any product in the market can be used.

In the (a) process, to the colloidal aqueous solution of activated silicate whose pH is 2-6 or to the acidic silica sol whose average particle size is 3-8 nm, a water-soluble metal salt of a II valent or III valent metal can be added, alone or as a mixture, desirably as a water solution thereof. The amount of a salt of metal of II valent or III valent to be added is the amount to be 1-10 wt % to $SiO_2$ in said colloidal aqueous solution of activated silicate or in acidic silica sol as a metal oxide (in the case of the metal salt of II valent metal is MO, in the case of the metal salt of II valent metal is $M_2O_3$, wherein M indicates a metal atom of II valent or III valent and O indicates an oxygen atom). This adding process is desirably carried out under stirring and the mixing temperature and time are not restricted, however, they are preferably 2-50° C. and from 5 minutes to 1 hour. As the metal salts of the II valent or III valent salt to be added, an inorganic acid salt or organic acid salt such as a chloride, nitrate, sulfate, sulfamate, formate or acetate of Ca, Mg, Sr, Ba, Zn, Sn, Pb, Ni, Co, Fe, Al, In, Y or Ti can be mentioned.

In the (b) process, an acidic spherical silica sol of average particle size of 10-80 nm and a pH of 2-6 is added to a mixture (a) obtained by the above (a) process. The acidic spherical silica sol of an average particle size (particle size D2 nm measured by a nitrogen absorption method) of 10-80 nm and pH of 2-6 can be a product prepared by a conventional method using water glass or an alkyl silicate as a starting material or can be a product which is sold on the market as an industrial material. In the case when a silica sol on the market is alkaline, it is possible to easily obtain an acidic silica sol by a cation exchange process of the alkaline silica sol on the market. A silica sol whose $SiO_2$ concentration is 10-50 wt % can be used. The ratio of D1, which is the measured particle size by a dynamic light scattering method, to D2, that is, D1/D2 value of the silica sol is generally less than 2, and it is desirable to use a silica sol whose D1/D2 ratio is smaller. The addition of said silica sol is desirably carried out immediately after the (a) process, under stirring. The mixing temperature and time are not restricted, however, it is preferable to be 2-50° C. and from 5 minutes to 1 hour.

The amount of acidic spherical silica sol having a 10-80 nm average particle size to be added at process (b) is the amount that the ratio A/B (by weight) of silica content (A) originating in the acidic spherical silica sol and silica content (B) originating in a mixture (a) obtained by the (a) process is 5-100, and the total silica content (A+B) in a mixture (b) obtained by the (b) process becomes 5-40 wt % as the $SiO_2$ concentration.

In the (c) process, an alkali metal hydroxide, water-soluble organic base or water-soluble silicate are added to a mixture (b) obtained by the above-mentioned (b) process. This addition process may be carried out immediately after the (b) process under stirring. The mixing temperature and time are not restricted, however, it is preferably 2-50° C. and from 5 minutes to 1 hour. It is desirable that the alkali metal hydroxide, water-soluble organic base or water-soluble silicate to be added are mixed homogeneously together with a liquid obtained in the (b) process. As an alkali metal hydroxide, for example, a hydroxide of sodium, potassium or lithium can be mentioned. As a water-soluble organic base, quaternary ammonium hydroxides such as tetraethanolammonium hydroxide, monomethyl triethanolammonium hydroxide or tetramethylammonium hydroxide, amines such as monoethanolamine, diethanolamine, triethanolamine, piperazine or morpholine can be mentioned. Further, as a water-soluble silicate, sodium silicate, potassium silicate or a quaternary ammonium silicate consisting of a base component of said quaternary ammonium hydroxide can be mentioned as an example. These alkali metal hydroxide, water-soluble organic bases and water-soluble silicates can be used by mixing.

In the (c) process, the adding amount of said alkali metal hydroxide, water-soluble organic base and water-soluble silicate are the amounts to make a pH of a mixture (c) obtained by the (c) process to be 7-11. When an alkali metal atom of the alkali metal hydroxide or a molecule of the organic base is indicated by M, the amount of the alkali metal, organic base or water-soluble silicate to be added are the amount to make the amount of the alkali metal of the organic base in an liquid obtained by the (c) process to silica content in a mixture (c) obtained by the (c) process to be 50-800 by $SiO_2/M_2O$ molar ratio.

In the (d) process, a mixture (c) obtained by the above (c) process is heated. This heating process is carried out at 100-200° C. and 0.5-50 hours heating time is needed. Further, this heating is desirably carried out by stirring said liquid and is desirably carried out in the condition that the vaporization of water does not occur.

At the heating of the mixture (c), the required power for stirring per unit volume is 0.01-5 $kW/m^3$. Especially, when the required power per unit volume is adjusted to 0.01-10 $kW/m^3$, the formation of the wet silica gel in the silica sol can be oppressed.

By this heating, spherical colloidal silica particles (particle size D2) and silica which connect said spherical colloidal silica particles are bonded by dehydration polycondensation reaction and connected in one plane, and chain colloidal silica particles of a particle size (D1) measured by dynamic light scattering method of 50-500 nm and D1/D2 value of 3 or more are formed.

Therefore, the obtained liquid is a silica sol and the $SiO_2$ concentration is generally 5-40 wt % and, when the concentration is too low, it is possible to condense it. At the condensation, it is desirable to remove anions from the silica sol obtained in the (d) process existing by an amount which disturbs the stabilization of silica sol when existing in concentrated silica sol. For the removal of anions, a method which uses a fine porous membrane such as an ultrafilter membrane or reverse osmosis membrane or a method using an ion-exchange resin can be mentioned. The pH of silica sol obtained by the (d) process or silica sol after condensation can be adjusted voluntarily by adding an alkali.

Silica sol obtained by the above-mentioned (d) process or the silica sol from which an adequate amount of anions or anions and water is characterized to be a $SiO_2$ concentration at 10-50 wt %, having a several mPa·s-1000 mPa·s viscosity and 8-11 pH at room temperature. In the present invention, the pH is desirably 6 or more. In this silica sol, although 100-2000 p.p.m. of anions are contained, the silica sol is very stable. This silica sol contains alkali metal ions and an organic base in an amount so that the $SiO_2/M_2O$ (wherein M is an alkali metal atom or organic base and O is an oxygen atom) molar ratio becomes 50-800, further, 100-10000 p.p.m. of a metal of II valent or III valent is contained in an amount converted to metal oxide to $SiO_2$.

Colloidal silica particles of this silica sol maintain the shape and size formed by said (d) process and contain metal oxides of II valent or III valent which are existing in said silica sol. A chemical analysis of them can be easily carried out by an ordinary method. The particle size by a dynamic light scattering method of this colloidal silica particle can be easily measured by an apparatus which is on the market, and is 50-500 nm.

Further, in the present invention, from the view point of water-resisting property, complex particles prepared by introducing colloidal silica into acrylic polymer components can be used, however, it is desirable that an acrylic polymer and colloidal silica are respectively used and contained thereon. The reason why is not clear, however, it is considered that it depends on the bonding condition of the acrylic polymer and colloidal silica. That is, in a case of complex particles type, colloidal silica surrounding an acryl particle are strongly bonded by a polymerization bond, and when it is used as a binder for a thermally sensitive layer, fusing or contacting of acryl particles to each other become difficult by the presence of colloidal silica and film-forming ability is obstructed. On the other hand, when acryl particles and colloidal silica are simply added, the colloidal silica combines with the acryl particles weakly by adsorption and does not obstruct the film formation caused by the acryl particles to each other, thus a strong film is formed so that the water-resisting property is further improved. Furthermore, by the good film-forming ability, the strength of a thermally sensitive recording layer is improved and a printing aptitude is also improved.

As an acryl polymer used in the present invention, it is desirable to use a polymer obtained by copolymerization using an alkyl acrylate, alkyl methacrylate or vinyl silane as a necessary monomer component and, when need arises, an emulsifier can be used to enable use as an aqueous emulsion which contains said copolymer.

Among a monomer which is a component composing the acryl polymer, the alkyl acrylate is specified to be an alkyl acrylate having an alkyl group with a carbon number of 1-10 and, specifically, methyl acrylate, ethyl acrylate, propyl acrylate, butyl acrylate, octyl acrylate, 2-ethylhexyl acrylate or 2-hydroxyethyl acrylate can be mentioned. Especially, butyl acrylate is desirable.

The alkyl methacrylate is specified to be an alkyl methacrylate having an alkyl group with a carbon number of 1-10 and, specifically, methyl methacrylate, ethyl methacrylate, butyl methacrylate, 2-ethylhexyl methacrylate or 2-hydroxyethyl methacrylate can be mentioned. Especially, methyl methacrylate is desirable.

As a specific example of a vinyl silane, vinyltrimethoxysilane, vinyltriethoxysilane, vinyltris(2-methoxy-ethoxy)silane, vinyltriacetoxy silane, γ-methacryloxypropyl-trimethoxysilane, vinyltrichlorosilane or γ-methacryloxypropyltris(methoxyethoxy)silane can be mentioned. Among these compounds, vinyltrimethoxysilane is especially desirable.

Further, as the other monomer which can be copolymerized with these mentioned monomers, styrene, N-methylolacrylamide, acrylic acid, methacrylic acid, itaconic acid, acrylamide, acrylonitrile, vinyl acetate or a vinyl ester of a saturated carboxylic acid can be mentioned. Especially, for the purpose of forming a film having a high strength, it is desirable to contain acrylonitrile or styrene partially. By using these compounds, good water-resisting property and good printing aptitude can be obtained.

Regarding the blending ratio of the above-mentioned monomers, the blending ratio of the alkyl acrylate to the alkyl methacrylate is 10-900 weight parts of alkyl methacrylate to 100 weight parts of alkyl acrylate, desirably 20-500 weight parts. The blending ratio of the vinyl silane is 0.5-10 weight parts to 100 weight parts of total alkyl acrylate and alkyl methacrylate, desirably 1-5 weight parts. Further, the blending ratio of the other monomers is 10-900 weight parts to 100 weight parts of total alkyl acrylate and alkyl methacrylate, desirably 20-500 weight parts.

By emulsion polymerization of these monomers under the presence of a polymerization initiator or an emulsifier, a copolymer can be obtained. As a method for polymerization, there is no limitation for a method of monomer feeding, and a lump together method, batch method or continuous feeding method can be used. Further, a method to polymerize a part previously then to feed the remaining part continuously can be used. The polymerization initiator and an emulsifier are not specifically restricted, and ordinary ones can be used. For Example, an alkali metal salt of a fatty acid, alkali metal alkylether carboxylate, alkali metal alkylbenzenesulfonate, alkali metal alkylnaphthalenesulfonate, alkali metal alkylsulfoacetate, alkali metal α-olefinsulfonate, alkali metal higher alcohol sulfonate, alkali metal alkylether sulfonate, alkali metal polyoxyethylenealkylphenylether sulfonate, polyoxyethylene-alkylether, polyoxyethylenealkylphenylether, polyoxyethylenesorbitan fatty acid ester, polyoxyethylenesorbitol fatty acid ester or polyoxyethyleneglycol fatty acid ester can be used.

In particular, a polymerizable emulsifier, which is a reactive monomer having the characteristics of an emulsifier, is desirable. When an ordinary emulsifier is used, since the ordinary emulsifier is ionic and the remaining emulsifier acts as a catalyst for the chemical reaction of a dye and a color developing agent and has the perilousness of developing a color of a coating for a thermally sensitive recording layer. On the contrary, when a polymerizable emulsifier, which is a reactive monomer having a characteristic of an emulsifier, is used, since the emulsifier is introduced into an acryl polymer, it does not affect the coating for a thermally sensitive recording layer. As a polymerizable emulsifier, any kind of emulsifier providing the above-mentioned property can be used and not restricted and, specifically, an alkali salt of alkylallylsulfosuccinate, sodium(glycerin-n-alkenylsuccino-ir-glycerin) borate, alkali salt of sulfopropylmaleic acid mono alkyl ester or polyoxyethylenealkyl ester of acrylic acid or methacrylic acid can be mentioned as a desirable example. The amount to be used is desirably 0.5 to 10 weight parts to 100 weight parts of total alkyl acrylate and alkyl methacrylate.

As the desirable blending amount of acryl polymer is 0.1-50 weight parts to 100 parts (hereinafter, weight parts is a converted amount to solid) of thermally sensitive recording layer and more desirably is 0.1-30 weight parts. When the amount is too small, it lacks the water-resisting property, while when the amount is too much, it causes a deterioration of sensitivity. The desirable blending amount of the colloidal silica is 1-500 weight parts to 100 parts of acrylic emulsion and more desirably is 10-300 weight parts. When the amount of colloidal silica is too small, the adhesion of dregs on a head or sticking are caused, while when the amount is too much, the stability of a coating of a thermally sensitive recording layer by time lapse becomes a problem.

When a further high water-resisting property is required, a thermally sensitive recording layer containing an acryl polymer, a colloidal silica and a cross-linking agent is provided, then the thermally sensitive recording layer may be heat treated at a temperature condition higher than 30° C. and lower than 60° C. for 24 hours.

As a color developing agent to be used in the present invention, any kind of color developing agent which is publicly known in the field of pressure sensitive thermally sensitive recording mediums can be used and not restricted and, for example, an inorganic acidic compound such as activated clay, attapulgite, colloidal silica or aluminum silicate, 4,4'-isopropyldiphenol, 1,1-bis(4-hydroxyphenyl)cyclohexane, 2,2-bis(4-hydroxyphenyl)-4-methylpentane, 4,4'-dihydroxydiphenylsulfide, hydroquinone-monobenzylether, 4-hydroxybenzylbenzoate, 4,4'-dihydroxy-diphenylsulfone, 2,4'-dihydroxydiphenylsulfone, 4-hydroxy-4'-isopropoxydiphenyl-sulfone, 4-hydroxy-4'-n-isopropoxydiphenylsulfone, bis(4-allyl-4-hydroxyphenyl)sulfone, 4-hydroxy-4'-methyldiphenyl-sulfone, 4-hydroxyphenyl-4'-benzyloxyphenylsulfone, 3,4-dihydroxyphenyl-4'-methylphenyl-sulfone, aminobenzenesulfoamide derivatives disclosed in JPH8-59603 A publication, bis(4-hydroxyphenylthioethoxy)methane, 1,5-di(4-hydroxyphenylthio)-3-oxapentane, bis(p-hydroxy-phenyl) butylacetate, bis(p-hydroxyphenyl)methylacetate, 1,1-bis(4-hydroxyphenyl)-1-phenylethane, 1,4-bis[α-methyl-α-(4'-hydroxyphenyl)ethyl]-benzene, 1,3-bis[a-methyl-α-(4'-hydroxyphenyl)ethyl]benzene, di(4-hydroxy-3-methylphenyl)-sulfide, 2,2'-thiobis(3-tert-octylphenol), 2,2'-thiobis(4-tert-octylphenol), a phenolic compound such as diphenylsulfone crosslinked compound disclosed in WO97/16420 International Publication, a compound disclosed in WO02/081229 International Publication or JP2002-301873 A publication, a thiourea compound such as N,N'-di-m-chlorophenylthiourea, thiourea compounds such as N,N'-di-m-chlorophenylthiourea, p-chlorobenzoic acid, stearyl gallate, bis[4-(n-octyloxycabonylamino)zinc-salicylate]di-hydrate, aromatic carboxylic acid such as 4-[2-(p-methoxyphenoxy) ethyloxy]salicylic acid, 4-[3-(p-tolylsulfonyl)propyloxy] salicylic acid or 5-[p-(2-p-p-methoxyphenoxyethoxycumyl) salicylic acid, and salts of these aromatic acids with a divalent metal such as zinc, magnesium, aluminium, calcium, titanium, manganese, thin or nickel, antipyrine complex of zinc thiocyanate, complex zinc salt of terephthalaldehydic and other aromatic carboxylic acid can be mentioned. These sensitizers can be used alone or in combination. Especially, dihydroxysulfone compounds, diphenylsulfone crosslinked compounds disclosed in WO97/16420 International Publication or 4-hydroxy-4'-n-propoxydiphenylsulfone are desirably used, and diphenylsulfone crosslinked compound can be purchased under the commodity name of D-90 of Nihon Soda Co., ltd. Further, a compound disclosed in WO02/081229 International Publication can be purchased under the commodity name of D-100 of Nihon Soda Co., ltd. Still further, it is possible to contain a metal chelete color developing component such as the higher fatty acid metal complex salt disclosed in JP H10-258577 A publication or divalent hydroxyl aromatic compounds.

As a basic leuco dye used in the present invention, any kind of dye which is publicly known in the fields of pressure-sensitive or thermally-sensitive recording mediums can be used and not restricted and, for example, triphenylmethane compounds, fluorane, fluorene or divinyl compounds are desirably used. Examples of specific colorless or pale colored dyes (dye precursors) are shown as follows. These dye precursors can be used alone or in combination.

<Triphenyl Methane Leuco Dye>

3,3'-bis(4-aminophenyl)-6-dimethylaminophthalide (Crystal Violet Lactone), 3,3-bis(p-dimethylaminophenyl)phthalide (Malachite Green Lactone)

<Fluorane Leuco Dyes>

3-diethylamino-6-methylfluorane
3-diethylamino-6-methyl-7-anilinofluorane
3-diethylamino-6-methyl-7-(o,p-dimethylanilino)fluorane
3-diethylamino-6-methyl-7-chlorofluorane
3-diethylamino-6-methyl-7-(m-trifluoromethylanilino)fluorane
3-diethylamino-6-methyl-7-(o-chloroanilino)fluorane
3-diethylamino-6-methyl-7-(p-chloroanilino)fluorane
3-diethylamino-6-methyl-7-(o-fluoroanilino)fluorane
3-diethylamino-6-methyl-7-(m-methylanilino)fluorane
3-diethylamino-6-methyl-7-n-octylanilinofluorane
3-diethylamino-6-methyl-7-n-octylaminofluorane
3-diethylamino-6-methyl-7-benzylanilinofluorane
3-diethylamino-6-methyl-7-dibenzylanilinofluorane
3-diethylamino-6-chloro-7-methylfluorane
3-diethylamino-6-chloro-7-anilinofluorane
3-diethylamino-6-chloro-7-p-methylanilinofluorane
3-diethylamino-6-ethoxyethyl-7-anilinofluorane
3-diethylamino-7-methylfluorane
3-diethylamino-7-chlorofluorane
3-diethylamino-7-(m-trifluoromethylanilino)fluorane
3-diethylamino-7-(o-chloroanilino)fluorane
3-diethylamino-7-(p-chloroanilino)fluorane
3-diethylamino-7-(o-fluoroanilino)fluorane
3-diethylamino-benzo[a]fluorane
3-diethylamino-benzo[c]fluorane
3-dibutylamino-6-methyl-fluorane
3-dibutylamino-6-methyl-7-anilinofluorane
3-dibutylamino-6-methyl-7-(o,p-dimethylanilino)fluorane
3-dibutylamino-6-methyl-7-(o-chloroanilino)fluorane
3-dibutylamino-6-methyl-7-(p-chloroanilino)fluorane
3-dibutylamino-6-methyl-7-(o-fluoroanilino)fluorane
3-dibutylamino-6-methyl-7-(m-trifluoromethylanilino)fluorane
3-dibutylamino-6-methyl-chlorofluorane
3-dibutylamino-6-ethoxyethyl-7-anilinofluorane
3-dibutylamino-6-chloro-7-anilinofluorane
3-dibutylamino-6-methyl-7-p-methylanilinofluorane
3-dibutylamino-7-(o-chloroanilino)fluorane
3-dibutylamino-7-(o-fluoroanilino)fluorane
3-di-n-pentylamino-6-methyl-7-anilinofluorane
3-di-n-pentylamino-6-methyl-7-(p-chloroanilino)fluorane
3-di-n-pentylamino-7-(m-trifluoromethylaniliono)fluorane
3-di-n-pentylamino-6-chloro-7-anilinofluorane
3-di-n-pentylamino-7-(p-chloroanilino)fluorane
3-pyrrolidino-6-methyl-7-anilinofluorane
3-piperidino-6-methyl-7-anilinofluorane
3-(N-methyl-N-propylamino)-6-methyl-7-anilinofluorane
3-(N-methyl-N-cyclohexylamino)-6-methyl-7-anilinofluorane
3-(N-ethyl-N-cyclohexylamino)-6-methyl-7-anilinofluorane
3-(N-ethyl-N-xylamino)-6-methyl-7-(p-chloroanilino)fluorane
3-(N-ethyl-p-toluidino)-6-methyl-7-anilinofluorane
3-(N-ethyl-N-isoamylamino)-6-methyl-7-anilinofluorane
3-(N-ethyl-N-isoamylamino)-6-chloro-7-anilinofluorane
3-(N-ethyl-N-tetrahydrofurfurylamino)-6-methyl-7-anilinofluorane
3-(N-ethyl-N-isobutylamino)-6-methyl-7-anilinofluorane
3-(N-ethyl-N-ethoxypropylamino)-6-methyl-7-anilinofluorane
3-cyclohexylamino-6-chlorofluorane
2-(4-oxahexyl)-3-dimethylamino-6-methyl-7-anilinofluorane
2-(4-oxahexyl)-3-diethylamino-6-methyl-7-anilinofluorane
2-(4-oxahexyl)-3-dipropylamino-6-methyl-7-anilinofluorane
2-methyl-6-p-(p-dimethylaminophenyl)aminoanilinofluorane
2-methoxy-6-p-(p-dimethylaminophenyl)aminoanilinofluorane
2-chloro-3-methyl-6-p-(p-phenylaminophenyl)amino-anilinofluorane
2-chloro-6-p-(p-dimethylaminophenyl)aminoanilinofluorane
2-nitro-6-p-(p-diethylaminophenyl)aminoanilinofluorane
2-amino-6-p-(p-diethylaminophenyl)aminoanilinofluorane
2-diethylamino-6-p-(p-diethylaminophenyl)aminoanilinofluorane
2-phenyl-6-methyl-6-p-(p-phenylaminophenyl)amino-anilinofluorane
2-benzyl-6-p-(p-phenylaminophenyl)aminoanilinofluorane
2-hydroxy-6-p-(p-phenylaminophenyl)aminoanilinofluorane
3-methyl-6-p-(p-dimethylaminophenyl)aminoanilinofluorane
3-diethylamino-6-p-(p-diethylaminophenyl)aminoanilinofluorane
3-diethylamino-6-p-(p-dibutylaminophenyl)aminoanilinofluorane
2,4-dimethyl-6-[(4-dimethylamino)anilino]-fluorane <Fluorene Leuco Dyes>

3,6,6'-tris(dimethylamino)spiro[fluorene-9,3'-phthalide]
3,6,6'-tris(diethylamino)spiro[fluorene-9,3'-phthalide]

<Divinyl Leuco Dyes>

3,3-bis-[2-(p-dimethylaminophenyl)-2-(p-methoxyphenyl) ethenyl]-4,5,6,7-tetrabromo phthalide
3,3-bis-[2-(p-dimethylaminophenyl)-2-(p-methoxyphenyl) ethenyl]-4,5,6,7-tetrachloro phthalide
3,3-bis-[1,1-bis(4-pyrrolidinophenyl)ethylene-2-yl]-4,5,6,7-tetrabromophthalide
3,3-bis-[1-(4-methoxyphenyl)-1-(4-pyrrolidinophenyl)ethylene-2-yl]-4,5,6,7-tetra chlorophthalide <Others>

3-(4-diethylamino-2-ethoxyphenyl)-3-(1-ethyl-2-methylindol-3-yl)-4-azaphthalide
3-(4-diethylamino-2-ethoxyphenyl)-3-(1-octyl-2-methylindol-3-yl)-4-azaphthalide
3-(4-cyclohexylethylamino-2-methoxyphenyl)-3-(1-ethyl-2-methylindol-3-yl)-4-azaphthalide
3,3-bis(1-ethyl-2-methylindol-3-yl)phthalide
3,6-bis(diethylamino)fluorane-γ-(3'-nitro)anilinolactam
3,6-bis(diethylamino)fluorane-y-(4'-nitro)anilinolactam
1,1-bis-[2',2',2",2"-tetrakis-(p-dimethylaminophenyl)-ethenyl]-2,2-dinitrilethane 1,1-bis-[2',2',2",2"-tetrakis-(p-dimethylaminophenyl)-ethenyl]-β-naphthoylethane 1,1-bis-[2',2',2",2"-tetrakis-(p-dimethylaminophenyl)-ethenyl]-2,2-diacetylethane bis-[2,2,2',2'-tetrakis-(p-dimethylaminophenyl)-ethenyl]-methylmalonic acid dimethyl ester.

In the present invention, as an adhesive contained in a thermally sensitive recording layer, namely as a binder, the above-mentioned acryl polymer and colloidal silica are mainly used, however, for the purpose of improving the fluidity of a coating, a publicly known adhesive for a thermally sensitive recording layer in an amount not to affect the desired effect of the present invention can be used. Specifically, a completely saponified polyvinyl alcohol having a degree of polymerization of 200 to 1,900, a partially saponified polyvinyl alcohol, a carboxy-modified polyvinyl alcohol, an amide-modified polyvinyl alcohol, a sulfonic acid-modified polyvinyl alcohol, a butyral-modified polyvinyl alcohol and other modified polyvinyl alcohols, cellulose derivatives such as hydroxyethylcellulose, methylcellulose, carboxymethylcellulose, ethylcellulose or acetylcellulose, a styrene-maleic anhydride copolymer, a styrene-butadiene copolymer, a cellulose derivative such as ethylcellulose or acetylcellulose, polyvinyl chloride, polyvinyl acetate, polyacrylamide, polyacrylate, polyvinyl butyral, polystyrene and a copolymer thereof, a polyamide resin, a silicon resin, a petroleum resin, a terpene resin, a ketone resin and a cumarone resin. When a partially saponified polyvinyl alcohol is used having a saponified degree smaller than 95%, a strong film is formed so that the water-resisting property and printing aptitude are improved and desirable. Those high molecular weight substances can be used by dissolving them in a solvent such as water, an alcohol, a ketone, an ester or a hydrocarbon or emulsifying or dispersing them as a paste in water or another medium, and can be used in combination according to the required quality.

Further, in the present invention, a conventional sensitizer can be used in an amount not obstructing the desired effect regarding the above-mentioned object of the present invention. As a specific example of the sensitizer, ethylenebisamide, montan wax, polyethylene wax, 1,2-di(3-methylphenoxy)ethane, p-benzylbiphenyl, β-benzyloxynaphthalene, 4-biphenyl-p-tolyl ether, m-terphenyl, 1,2-diphenoxyethane, 4,4'-ethylenedioxy-bis-dibenzyl benzoate, dibenzoyloxymethane, 1,2-di(3-methylphenoxy)ethylene, 1,2-diphenoxyethylene, bis[2-(4-methoxy-phenoxy)ethyl]ether, methyl p-nitrobenzoate, dibenzyloxalate, di(p-chlorobenzyl) oxalate, di(p-mrthylbenzyl)oxalate, dibenzylterephthalate, benzyl p-benzyloxybenzoate, di-p-tolylcarbonate, phenyl-α-naphythylcarbonate, 1,4-diethoxynaphthalene, phenyl 1-hydroxy-2-naphthoate, 4-(m-methylphenoxymethyl)biphenyl, orthotoluenesulfonamide and paratoluenesulfonamide, however, the invention is not limited to these compounds. These sensitizers can be used alone or can be used in combination.

As a filler to be used in the present invention, an inorganic filler such as silica, calcium carbonate, kaolin, calcined kaolin, diatomaceous earth, talc, titanium oxide or aluminum hydroxide or an organic filler can be mentioned. In particular, titanium oxide of an average particle size of 8-15 μm is desirable, because it effectively prevents the accumulation of dregs on a head and sticking. When silica of more than 100 ml/100 g (JIS K5101) oil-absorbing ability, less than 150 $m^2/g$ BET specific surface area and smaller than 5 μm average particle size is contained, voids are formed in a thermally sensitive recording layer and it is considered that a fused subject is absorbed in the voids so that the formation of dregs on a head is prevented, therefore, said silica is desirably used.

Besides these compounds, a slipping agent such as waxes, an ultra-violet ray absorbing agent such as benzo-phenones or triazoles, a water-resisting agent such as glyoxal, a dispersing agent, a defoaming agent, an antioxidant or a fluorescent dye can be used.

Furthermore, in the present invention, a stabilizer which displays an oil repellent effect to the recorded image can be used in an amount not obstructing the desired effect regarding the above-mentioned object of the present invention. As the specific example of the stabilizer, 4,4'-butylidenebis(6-t-butyl-3-methylphenol), 2,2'-di-t-butyl-5,5'-dimethyl-4,4'-sulphonyldiphenyl, 1,1,3-tris(2-methyl-4-hydroxy-5-cyclohexylphenyl)butane, 1,1,3-tris(2-methyl-4-hydroxy-5-t-butylphenyl)butane, 4-benzyloxy-4'-(2,3-epoxy-2-methylpropoxy)diphenylsulfone or epoxy resin can be added.

The kinds and amounts of basic leuco dye, color developing agent and other components which are used in the thermally sensitive recording medium of the present invention, are decided according to the required properties and recording suitability and not restricted, however, ordinarily, 0.5 to 10 parts of color developing agent and 0.5 to 10 parts of filler to 1 part of basic leuco dye is used.

The subjected thermally sensitive recording medium can be obtained by applying the coating composed of the above-mentioned composition on a substrate such as paper, recycled paper, synthetic paper, film, plastic film, plastic foam film or non-woven cloth. A composite sheet which is prepared by combining these substrates can be used as a substrate. In a case when excellent water resisting ability is required, it is possible to use a paper whose Bekk smoothness after being water coated is more than 30 sec. as a substrate. The wet paper strength of the paper is improved by adding a wet paper strength enhancing agent, further, a neutral paper is desirably used in place of an acidic paper.

Basic leuco dye, color developing agent and other materials to be added by necessity are pulverized by a ball mill, an attriter or a sand grinder, or by means of an adequate emulsifying apparatus, until they are pulverized under several microns size, then add an acrylic emulsion, colloidal silica and various additives according to the object and prepare a coating. The means for coating is not restricted and publicly known conventional methods can be used and, specifically, for example, an off machine coater with various coaters such as an air knife coater, rod blade coater, bill blade coater or roll coater or an on machine coater can be voluntarily chosen and used. The coating amount for a thermally sensitive layer is not specifically restricted and, in general, is in the range of from 2 to 12 $g/m^2$ by dry weight.

Still further, the thermally sensitive recording medium of the present invention can have an overcoating layer consisting of a polymer on the thermally sensitive recording layer to improve its preservability and can provide an undercoating layer consisting of a polymer containing a filler under the thermally sensitive recording layer to improve the color developing sensitivity and a back coating layer can be provided on the opposite side of the substrate to which the thermally sensitive recording is provided for the purpose of preventing the curling of the sheet. Yet further, various publicly known techniques in the field of thermally sensitive recording mediums can be added voluntarily, for example, to carry out a smoothness treatment such as a super calendar treatment after the coating process of each layer.

EXAMPLE

The thermally sensitive recording medium of the present invention will be illustrated more according to the Examples. In the illustrations, "parts" and "%" indicates "weight parts" and "weight %".

The following evaluation tests are carried out on specimens of thermally sensitive recording media obtained in the Examples and Comparative Examples.

Color Developing Sensitivity

The produced thermally sensitive recording medium was subjected to printing at an applied energy of 0.25 mJ/dot and 0.34 mJ/dot by using TH-PMD (manufactured by Okura Denki). The image densities were measured by a Macbeth Densitometer (using an amber filter).

Water Resistance

One water drop is dropped on the surface of a thermally sensitive layer and, after 10 minutes, scrubbed by a tissue paper and the removal of a recording surface is measured by the eyes of an operator and evaluated by the following standard.

○: removal of recorded surface is not observed

Δ: removal of recorded surface is observed slightly.

X: much removal is observed

Printing Aptitude

RI printing is carried out on the surface of a thermally sensitive recording medium by UV ink and the ink coming off is measured by the eyes of an operator and evaluated by following standard.

○: ink coming off is not observed

Δ: ink coming off is observed slightly

X: much ink coming off is observed

Dregs on a Head

The produced thermally sensitive recording medium was subjected to printing at an applied energy of 0.34 mJ/dot by using TH-PMD of Okura Denki and the dregs on a head were measured and evaluated by the following standard.

○: dregs on a head are not observed

Δ: dregs on a head are observed slightly

X: dregs on a head are observed

Synthesis Example 1

An aqueous solution of sodium silicate whose $SiO_2$ concentration is 3.6 weight % is obtained by adding DI water to water glass of JIS class 3 on the market ($SiO_2/Na_2O$ molar ratio 3.22, $SiO_2$ concentration; 28.5 weight %). The aqueous solution of sodium silicate is passed though a column in which a cation-exchange resin, commodity name Umberlight 120B, is filled and an aqueous colloidal solution of activated silicic acid whose $SiO_2$ concentration is 3.60 weight %, pH is 2.90 and electric conductivity is 580 μS/cm is obtained. 888 g of the obtained aqueous colloidal solution of activated silicic acid ($SiO_2$ content is 32.0 g) is poured into a glass container and 600 g of DI water is added under stirring and an aqueous colloidal solution of activated silicic acid whose $SiO_2$ concentration is 2.15 weight % and pH is 3.07, is obtained. Then, 59 g of 10 wt % calcium nitrate aqueous solution (pH 4.32) (CaO content 2.02 g) is added to the colloidal aqueous solution by stirring at room temperature and stirring is continued for 30 minutes. The added calcium nitrate is 6.30 wt % to $SiO_2$ as CaO.

While, 2000 g of acidic spherical silica sol of Snow Tex 0-40 (product of Nissan Kagaku Kogyo Co., Ltd.) (specific gravity; 1.289, viscosity; 4.10 mPa·s, pH; 2.67, electric conductivity; 942 μS/cm, $SiO_2$ concentration; 40.1 weight %) ($SiO_2$ content. 802 g), whose average particle size (by nitrogen absorbing method/D2) is 20.5 nm, is poured into another glass container, then 6.0 g of 5 wt % aqueous solution of sodium hydroxide is added to said glass container by stirring, and stirring is continued for 30 minutes, thus an acidic silica sol whose pH is 4.73 and $SiO_2$ concentration is 40.0 wt % is obtained.

The measured particle size by the dynamic light scattering method of this silica sol (D1) is 35.0 nm and D1/D2 value is 1.71. According to an electric microscopic observation, the shape of the colloidal silica particles in this silica sol is spherical and the dispersion state is similar to a monodispersion, and bonding between particles and flocculation are not observed.

This acidic spherical silica sol of 20.5 nm is added to the afore-mentioned colloidal aqueous solution of activated silicate to which calcium nitrate is added (mixture (a)) and stirred for 30 minutes.

The obtained mixture (b) is characterized in that the ratio A/B (by weight) of silica content (A) originating from the acidic spherical silica sol and silica content (B) originating from the colloidal aqueous solution of activated silicate (mixture (a)) is 25.1, pH is 3.60, electric conductivity is 2580 μS/cm and total silica content (A+B) in mixture (b) is 23.5 wt % as $SiO_2$ concentration. Calcium ion existing in the solution as CaO is 0.242 wt % to $SiO_2$.

Then, 330 g of a 1.97 weight % aqueous solution of sodium hydroxide is added under stirring for 10 minutes, and stirring is continued for another 1 hour. Mixture (c) obtained by the addition of the aqueous solution of sodium hydroxide has a pH of 9.2, electric conductivity of 3266 μS/cm, $SiO_2$ concentration of 21.5 wt % and molar ratio of $SiO_2/Na_2O$ of 163.5. In this mixture (c), the presence of a small amount of silica gel is observed.

After that, 1800 g of the above-mentioned alkaline mixture (c) is poured into a stainless steel autoclave, heated at 145° C. under stirring for 3 hours, then cooled down and the whole content of 1800 g removed. The obtained liquid is a silica sol of a transparent colloidal color (chain silica sol A) of $SiO_2$ concentration; 21.5 wt %, molar ratio; $SiO_2/Na_2O$ 200, pH; 9.62, specific gravity; 1.141, viscosity; 91.7 mPa·s, electric conductivity; 3290 μS/cm, transmittance; 59.0% and measured particle size by dynamic light scattering method (D1) of 177 nm. Therefore, the D1/D2 ratio is 8.63.

Synthesis Example 2

1800 g of alkaline mixture (c) obtained in Synthesis Example 1 is poured into a stainless steel autoclave, heated at 135° C. under stirring for 3 hours, then cooled down and whole content of 1800 g is removed. The obtained liquid is a silica sol of a transparent colloidal color (chain silica sol B) of a $SiO_2$ concentration; 21.5 wt %, pH; 9.56, specific gravity; 1.141, viscosity; 4.5 mPa·s, electric conductivity; 3285 μS/cm and measured particle size by dynamic light scattering method (D1) of 116 nm. Therefore, the D1/D2 ratio is 5.66.

Synthesis Example 3

151 g of acidic silica sol Snow Tex OXA (product of Nissan Kagaku Kogyo Co., Ltd.) (specific gravity; 1.062, viscosity; 1.2 mPa·s, pH; 2.90, electric conductivity; 370 μS/cm, $SiO_2$ concentration; 10.6 weight %) having a 5.6 nm average particle size (SHIARS method/D3) ($SiO_2$ contents; 16.0 g) was poured into a glass container, 593 g of DI water was added under stirring and an acidic silica sol of $SiO_2$ concentration; 2.15 weight %, pH; 3.42 was obtained. The measured particle size (D1) of this silica sol measured by the dynamic light scattering method was 14.4 nm and the D1/D3 value was 2.57. After that, 31 g of 10 wt % calcium nitrate aqueous solution (pH 4.32) (CaO content 1.06 g) was added to the colloidal aqueous solution by stirring at room temperature and the stirring was continued for 30 minutes. The added calcium nitrate was 6.63 wt % to $SiO_2$ as CaO.

1000 g of acidic spherical silica sol of Snow Tex 0-40 ($SiO_2$ content; 401 g), whose average particle size (D2) was 20.5 nm, was poured into another glass container, then 3.0 g of 5 wt % aqueous solution of sodium hydroxide was added to the glass container by stirring, and the stirring was continued for 30 minutes, thus acidic silica sol whose pH was 4.73 and $SiO_2$ concentration was 40.0 wt % was obtained.

The acidic silica sol of average particle size 20.5 nm was added to the afore-mentioned acidic silica sol of an average particle size of 5.0 nm to which calcium nitrate was added under stirring, and the stirring was continued for another 30 minutes. The obtained mixture (b) was characterized in that the ratio A/B (by weight) of silica content (A) originating from the acidic spherical silica sol and silica content (B) originating from the colloidal aqueous solution of activated silicate (mixture (a)) was 25.1, pH was 4.07, electric conductivity was 3050 μS/cm and total silica content (A+B) in mixture (b) was 23.5 wt % as $SiO_2$ concentration. The calcium ion in the solution as CaO was 0.254 wt % to $SiO_2$.

Then, 65 g of a 5.0 weight % aqueous solution of sodium hydroxide was added to the obtained mixture (b) under stirring for 5 minutes and the stirring was continued another 1 hour. Mixture (c) obtained by the addition of the aqueous solution of sodium hydroxide had a pH; 9.42, electric conductivity; 3820 μS/cm, $SiO_2$ concentration; 22.6 wt % and molar ratio $SiO_2/Na_2O$; 163.5. The presence of a silica gel in this mixture (c) was not observed.

After that, 1800 g of the above-mentioned alkaline mixture (c) was poured into a stainless steel autoclave and heated at 140° C. under stirring for 3 hours. Then, it was cooled and the whole content of 1800 g was taken out. Although a small amount of silica gel was present, the obtained liquid was a silica sol of transparent colloidal color having a $SiO_2$ concentration; 22.6 wt %, pH; 9.57, specific gravity; 1.148, viscosity; 800 mPa·s, electric conductivity; 3650 μS/cm, transmittance; 56.9% and measured particle size by dynamic light scattering method (D1) of 194 nm. Therefore, the D1/D2 ratio was 9.46.

Synthesis Example 4

A colloidal aqueous solution of activated silicate of $SiO_2$ concentration; 3.60 wt %, pH; 2.91 and electric conductivity; 580 μS/cm mentioned in Synthesis Example 1 was used.

532 g of this colloidal aqueous solution of activated silicate ($SiO_2$ content; 19.2 g) was poured into a glass container, 200 g of DI water was added by stirring and a colloidal aqueous solution of activated silicate of $SiO_2$ concentration; 2.62 wt % and pH; 3.02 was obtained. Then, 35.4 g of 10 wt % aqueous solution of calcium nitrate (pH; 4.32) (CaO content; 1.21 g) was added by stirring at room temperature, and the stirring was continued another 30 minutes. The added calcium nitrate was 6.32 wt % as CaO to $SiO_2$.

1600 g of acidic spherical silica sol of Snow Tex OML (product of Nissan Kagaku Kogyo Co., Ltd.) (specific gravity; 1.404, viscosity; 12.7 mPa·s, pH; 2.15, electric conductivity; 2405 μS/cm, $SiO_2$ concentration; 50.0 weight %) ($SiO_2$ content; 800 g), was poured into another glass container, then 9.0 g of 5 wt % aqueous solution of sodium hydroxide was added to the glass container by stirring, and the stirring was continued for 30 minutes. Thus, acidic silica sol whose pH was 5.04 and $SiO_2$ concentration was 49.7 wt % was obtained. The measured particle size by the dynamic light scattering method (D1) of Snow Tex OML was 54.4 nm and D1/D2 ratio was 1.47. To the colloidal solution of activated silicate to which the calcium nitrate was added (mixture (a)), the above-mentioned acidic silica sol having a 37.0 average particle size was added under stirring and stirring was continued for another 30 minutes.

The obtained mixture (b) was characterized in that the ratio A/B (by weight) of the silica content (A) originating from the acidic spherical silica sol and the silica content (B) originating from the colloidal aqueous solution of activated silicate (mixture (a)) was 42.1, pH was 4.03, electric conductivity was 2900 μS/cm and total silica content (A+B) in mixture (b) was 34.6 wt % as $SiO_2$ concentration. The calcium ion in the solution as CaO was 0.148 wt % to $SiO_2$.

Then, 40 g of a 10 weight % aqueous solution of sodium hydroxide was added to the obtained mixture (b) under stirring for 5 minutes and the stirring was continued another hour. The mixture obtained by the addition of the aqueous solution of sodium hydroxide had a pH; 9.24, electric conductivity; 3920 μS/cm, $SiO_2$ concentration; 34.0 wt % and $SiO_2/Na_2O$ molar ratio; 245. The presence of small amounts of silica sol was observed in this mixture (c).

After that, 1800 g of the above-mentioned alkaline mixture (c) was poured into a stainless steel autoclave and heated at 150° C. under stirring for 3 hours, cooled and the whole content of 1800 g taken out. The presence of a silica gel was not detected in the obtained liquid and the obtained liquid was a silica sol of a transparent colloidal color having a $SiO_2$ concentration; 34.0 wt %, pH; 9.54, specific gravity; 1.240, viscosity; 42.9 mPa·s, electric conductivity; 3685 μS/cm, transmittance; 24.1% and measured particle size by dynamic light scattering method (D1) was 155 nm. Therefore, the D1/D2 ratio was 4.19.

Synthesis Example 5

560 g of a colloidal aqueous solution of the activated silicate obtained in Synthesis Example 1 was poured into a glass container, 300 g of DI water was added by stirring and a colloidal aqueous solution of activated silicate of a $SiO_2$ concentration; 2.34 wt % and pH; 3.05 was obtained. Then, 37.2 g of a 10 wt % aqueous solution of calcium nitrate (pH; 4.32) (CaO content; 1.27 g) was added by stirring at room temperature and the stirring was continued another 30 minutes. The added calcium nitrate was 6.30 wt % as CaO to $SiO_2$.

1440 g of acidic spherical silica sol of Snow Tex O (product of Nissan Kagaku Kogyo Co., Ltd.) (specific gravity; 1.126, viscosity; 1.7 mPa·s, pH; 2.70, electric conductivity; 390 μS/cm, $SiO_2$ concentration; 20.3 weight %, $Al_2O_3$ concentration; 430 p.p.m., $Fe_2O_3$ concentration; 7 p.p.m., CaO concentration; 2 p.p.m., MgO concentration; 3 p.p.m.) ($SiO_2$ content; 292 g) whose average particle size (by nitrogen absorption method/D2) was 12.3 nm, was poured into another glass container. Then, 3.0 g of a 5 wt % aqueous solution of sodium hydroxide was added to the glass container by stirring and the stirring was continued for 30 minutes. Thus, an acidic silica sol whose pH was 5.47 and $SiO_2$ concentration was 20.2 wt % was obtained. The measured particle size by the dynamic light scattering method (D1) of this silica sol was 19.4 nm and the D1/D2 ratio is 1.62. According to electric microscope observation, the shape of the colloidal silica particles in this silica sol was spherical, the dispersion state was close to a monodispersion and bonding between the particles and flocculation were not observed. To the colloidal solution of the activated silicate to which calcium nitrate was added, mixture (a), the above-mentioned acidic silica sol having a 12.0 nm average particle size was added under stirring and the stirring was continued for another 30 minutes.

The obtained mixture (b) was characterized that the ratio A/B (by weight) of the silica content (A) originating from the acidic spherical silica sol and the silica content (B) originating from the colloidal aqueous solution of activated silicate, mixture (a), was 14.5, pH was 4.25, electric conductivity was 2600 μS/cm and total silica content (A+B) in the mixture (b) was 13.3 wt % as $SiO_2$ concentration. The calcium ion in the solution as CaO was 0.407 wt % to $SiO_2$.

Then, 111 g of a 5.0 weight % aqueous solution of sodium hydroxide was added to the obtained mixture (b) under stirring for 10 minutes and the stirring was continued for another hour. The mixture (c) obtained by the addition of the aqueous solution of sodium hydroxide had a pH; 9.70, electric conductivity; 3605 μS/cm, $SiO_2$ concentration; 12.7 wt % and $SiO_2/Na_2O$ molar ratio; 73.0. The presence of small amounts of silica sol was observed in this mixture (c).

1800 g of the above-mentioned alkaline mixture (c) was poured into a stainless steel autoclave heated at 130° C. under stirring for 3 hours, cooled and the whole content of 1800 g taken out. The presence of silica gel was not detected in the obtained liquid and the obtained liquid was a silica sol of a transparent colloidal color having a $SiO_2$ concentration; 12.7 wt %, pH; 10.03, specific gravity; 1.082, viscosity; 79.5 mPa·s, electric conductivity; 3635 μS/cm and measured particle size by dynamic light scattering method (D1) of 163 nm. Therefore, the D1/D2 ratio was 13.6.

Synthesis Example 6

346 g of the colloidal aqueous solution of activated silicate obtained in Synthesis Example 1 ($SiO_2$ content; 12.5 g) was poured into a glass container, then, 41.4 g of 10 wt % of an aqueous solution of calcium nitrate (pH; 4.32) (CaO content; 1.41 g) was added under stirring at room temperature and the stirring was continued another 30 minutes. The added calcium nitrate was 11.28 wt % as CaO to $SiO_2$.

2063 g of acidic spherical silica sol of Snow Tex-O25 (product of Nissan Kagaku Kogyo Co., Ltd.) (specific gravity; 1.16, viscosity; 2.9 mPa·s, pH; 2.70, electric conductivity; 1020 μS/cm, $SiO_2$ concentration; 25.1 weight %) ($SiO_2$ content; 517.8 g), whose average particle size (by nitrogen absorption method/D2) was 12.0 nm, was poured into another glass container, then 8.0 g of a 5 wt % aqueous solution of sodium hydroxide was added to the glass container while stirring and the stirring is continued for 30 minutes. Thus, an acidic silica sol whose pH was 4.65 and $SiO_2$ concentration was 25.0 wt % was obtained. The measured particle size by the dynamic light scattering method (D1) of this silica sol was 20.5 nm and D1/D2 ratio was 1.71. According to electric microscope observation, the shape of the colloidal silica particles in this silica sol was spherical, the dispersion state was close to a monodispersion and bonding between particles and flocculation were not observed. To the colloidal solution of activated silicate to which calcium nitrate was added, mixture (a), the above-mentioned acidic silica sol having a 12.0 nm average particle size was added under stirring and stirring was continued for 30 minutes.

The obtained mixture (b) was characterized in that the ratio A/B (by weight) of the silica content (A) originating from the acidic spherical silica sol and the silica content (B) originating from the colloidal aqueous solution of activated silicate, mixture (a), was 41.4, pH was 3.90, electric conductivity was 2600 μS/cm and total silica content (A+B) in mixture (b) was 21.6 wt % as $SiO_2$ concentration. The calcium ion in the solution as CaO was 0.267 wt % to $SiO_2$.

Then, 155 g of a 5.0 weight % aqueous solution of sodium hydroxide was added to the obtained mixture (b) under stirring for 10 minutes and the stirring was continued for another hour. Mixture (c) obtained by the addition of the aqueous solution of sodium hydroxide had a pH; 9.89, electric conductivity; 3940 μS/cm, $SiO_2$ concentration; 20.3 wt % and $SiO_2/Na_2O$ molar ratio; 86.9. The presence of a small amount of silica sol was observed in mixture (c).

1800 g of the above-mentioned alkaline mixture (c) was poured into a stainless steel autoclave, heated at 138° C. under stirring for 5 hours, cooled and the whole content of 1800 g taken out. The obtained liquid was a silica sol of a transparent colloidal color and had a $SiO_2$ concentration; 20.3 wt %, pH; 10.15, specific gravity; 1.130, viscosity; 14.5 mPa·s, electric conductivity; 3770 μS/cm and measured particle size by dynamic light scattering method (D1) of 117 nm. Therefore, the D1/D2 ratio was 9.8.

Example 1

Dispersions of the following blending ratio for each of the materials for the dye and color developing agent were prepared and ground in a wet condition by using a sand grinder to an average particle size of 0.5 μm.

<Dispersion of Color Developing Agent>

| | |
|---|---|
| 4-hydroxy-4'-isopropoxydiphenylsulfone | 6.0 parts |
| 10% aqueous solution of polyvinyl alcohol | 18.8 parts |
| water | 11.2 parts |

<Dispersion of Dye>

| | |
|---|---|
| 3-di-n-butylamino-6-methyl-7-anilinofluorane (OBD-2) | 3.0 parts |
| 10% aqueous solution of polyvinyl alcohol | 6.9 parts |
| water | 3.9 parts |

<Dispersion of Sensitizer>

| | |
|---|---|
| stearic acid amide (average particle size 0.4 μm) | 6.0 parts |
| 10% aqueous solution of polyvinyl alcohol | 18.8 parts |
| water | 11.2 parts |

The above-mentioned dispersions are mixed according to the ratio mentioned below and a coating for a thermally sensitive layer is obtained. The coating is coated and dried on a surface of a woodfree paper having a basic weight of 50 $g/m^2$ such that the coating amount after drying was 6 $g/m^2$. The resultant product is treated by a supercalender to have a Bekk smoothness of 200 to 600 sec and a thermally sensitive recording medium is obtained.

| | |
|---|---|
| Dispersion of color developing agent | 36.0 parts |
| Dispersion of dye | 13.8 parts |
| Dispersion of sensitizer | 36.0 parts |
| 50% dispersion of aluminum hydroxide | 26.0 parts |
| 30% dispersion of zinc stearate | 6.7 parts |
| Acrylic polymer A (solid part; 40%) | 20.0 parts |
| Monomer component | (ratio) |
| Methyl methacrylate | 30 parts |
| Butyl acrylate | 70 parts |
| Vinyltrimethyl silane | 2 parts |
| Acrylonitrile | 5 parts |
| Chain colloidal silica of Synthesis Example 1 ($SiO_2$ conc.; 21.5%) | 20.0 parts |

Example 2

By the same process as Example 1, except for using a chain colloidal silica of Synthesis Example 2 in a process for the formation of a thermally sensitive layer, a thermally sensitive recording medium is obtained.

Example 3

By the same process as Example 1 except for using a chain colloidal silica of Synthesis Example 3 in a process for the formation of a thermally sensitive layer, a thermally sensitive recording medium is obtained.

Example 4

By the same process as Example 1 except for using a chain colloidal silica of Synthesis Example 4 in a process for the formation of a thermally sensitive layer, a thermally sensitive recording medium is obtained.

Example 5

By the same process as Example 1 except for using a chain colloidal silica of Synthesis Example 5 in a process for the formation of a thermally sensitive layer, a thermally sensitive recording medium is obtained.

Example 6

By the same process as Example 1 except using a chain colloidal silica of Synthesis Example 6 in a process for the formation of a thermally sensitive layer, a thermally sensitive recording medium is obtained.

Example 7

By the same process as Example 1 except for using 20.0 parts of an acidic (pH 2-4) chain colloidal silica prepared by treating the chain colloidal silica sol of Synthesis Example 1 by the following process instead of using 20.0 parts of a chain colloidal silica in a process for the formation of a thermally sensitive layer, a thermally sensitive recording medium is obtained. That is, the chain colloidal silica sol of Synthesis Example 1 is demineralized and condensed by an ultrafilter membrane of a fractionated molecular weight of 50,000 at room temperature using a plane ultrafiltration apparatus and treated by Umberlight 120B cation exchanging resin.

Example 8

Dispersions of the following blending ratios for each of the materials for the dye and color developing agent are prepared, and ground in a wet condition by using a sand grinder to an average particle size of 0.5 μm.

<Dispersion of Color Developing Agent>

| | |
|---|---|
| diphenylsulfone crosslinked compound (product of Nihon Soda Co., ltd. Comodity name D-90) | 6.0 parts |
| 10% aqueous solution of polyvinyl alcohol | 18.8 parts |
| water | 11.2 parts |

<Dispersion of Dye>

| | |
|---|---|
| 3-di-n-butylamino-6-methyl-7-anilinofluorane (OBD-2) | 3.0 parts |
| 10% aqueous solution of polyvinyl alcohol | 6.9 parts |
| water | 3.9 parts |

<Dispersion of Sensitizer>

| | |
|---|---|
| stearic acid amide (average particle size 0.4 μm) | 6.0 parts |
| 10% aqueous solution of polyvinyl alcohol | 18.8 parts |
| water | 11.2 parts |

The above-mentioned dispersions are mixed according to the ratios mentioned below and a coating for a thermally sensitive layer is obtained. The coating is coated and dried on a surface of a woodfree paper having a basic weight of 50 $g/m^2$ such that the coating amount after drying was 6 $g/m^2$. The resultant product was treated by a supercalender to have a Bekk smoothness of 200 to 600 sec, and a thermally sensitive recording medium was obtained. The components of the acrylic polymer used in Examples 8-13 are shown in Table 2.

| | |
|---|---|
| Dispersion of color developing agent | 36.0 parts |
| Dispersion of dye | 13.8 parts |
| Dispersion of sensitizer | 36.0 parts |
| 50% dispersion of aluminum hydroxide | 26.0 parts |
| 30% dispersion of zinc stearate | 6.7 parts |
| aqueous emulsion of acrylic polymer a (solid part 40%) | 20.0 parts |
| colloidal silica (product of Clariant Japan, commodity name; Crebosol 40R12, average particle size; 12 nm) | 5.0 parts |

Example 9-13

By the same process as Example 8, except for using aqueous emulsions of acrylic polymers b-g (solid parts 40%) instead of acrylic polymer a in a process for the formation of a thermally sensitive layer, a thermally sensitive recording medium is obtained.

Comparative Example 1

By the same process as Example 1 except for using 20 parts of an acrylic polymer A and not blending a chain colloidal silica in a process for the formation of a thermally sensitive layer, a thermally sensitive recording medium was obtained.

Comparative Example 2

By the same process as Example 1 except for using 40 parts of a 10% polyvinylalcohol (product of Kuraray, commoditiy name PVA117) instead of 20.0 parts of an acrylic polymer in a process for the formation of a thermally sensitive layer, a thermally sensitive recording medium was obtained.

Comparative Example 3

By the same process as Example 1 except for using 20 parts of an acrylic emulsion/colloidal silica composite resin (product of Clariant Japan, commodity name; Movinyl 8020, solid part; 40%) instead of 20.0 parts of an acrylic polymer and 20.0 parts of colloidal silica in a process for the formation of a thermally sensitive layer, a thermally sensitive recording medium is obtained.

The component of the acrylic polymer and construction of the Examples and Comparative Examples are summarized in Table 1 and Table 2 and the evaluation results of the obtained thermally sensitive recording medium are summarized in Table 3.

TABLE 1

| | Chain colloidal silica | (D1: dynamic light scattering method, D2: BET) D1 | D2 | D1/D2 | pH | Acrylic polymer |
|---|---|---|---|---|---|---|
| Example | | | | | | |
| 1 | Synthesis Ex. 1 (chain) | 177 nm | 20.5 nm | 8.63 | 9.62 | A |
| 2 | Synthesis Ex. 2 (chain) | 116 nm | 20.5 nm | 5.66 | 9.56 | A |
| 3 | Synthesis Ex. 3 (chain) | 194 nm | 20.5 nm | 9.46 | 9.57 | A |
| 4 | Synthesis Ex. 4 (chain) | 155 nm | 37.0 nm | 4.19 | 9.54 | A |
| 5 | Synthesis Ex. 5 (chain) | 163 nm | 12.0 nm | 13.6 | 10.03 | A |
| 6 | Synthesis Ex. 6 (chain) | 117 nm | 12.0 nm | 9.8 | 10.15 | A |
| 7 | Synthesis Ex. 1' (acidic) | 177 nm | 20.5 nm | 8.63 | 3.5 | A |
| Comparative Example | | | | | | |
| 1 | No | | | | | A |
| 2 | Synthesis Ex. 1 (chain) | 177 nm | 20.5 nm | 8.64 | 9.62 | PVA-117 |
| 3 | composite | | | | | Movinyl 8020 |

TABLE 2

| Acrylic polymer | | monomer | Blending ratio |
|---|---|---|---|
| Example 8 | a | methyl methacrylate | 30 |
| | | butyl acrylate | 70 |
| | | vinyl trimethylsilane | 2 |
| Example 9 | b | 2-ethylhexyl methacrylate | 40 |
| | | methyl acrylate | 60 |
| | | vinyltrimethoxy silane | 5 |
| Example 10 | c | methyl methacrylate | 80 |
| | | propyl acrylate | 20 |
| | | vinyl trimethylsilane | 2 |
| Example 11 | e | methyl methacrylate | 30 |
| | | butyl acrylate | 70 |
| | | vinyl trimethylsilane | 2 |
| | | styrene | 20 |
| Example 12 | f | 2-ethylhexyl methacrylate | 40 |
| | | methyl acrylate | 60 |

TABLE 2-continued

| Acrylic polymer | | monomer | Blending ratio |
|---|---|---|---|
| | | vinyltrimethoxy silane | 5 |
| | | N-methylolacrylamide | 50 |
| Example 13 | g | methyl methacrylate | 30 |
| | | butyl acrylate | 70 |
| | | vinyl trimethylsilane | 2 |
| | | styrene | 20 |
| | | acrylonitrile | 50 |

TABLE 3

| | Color developing sensitivity (1)/(2) | Water resistance | Printing aptitude | Dregs on a head |
|---|---|---|---|---|
| Example 1 | 0.91/1.23 | ○ | ○ | ○ |
| Example 2 | 0.88/1.20 | ○ | ○ | ○ |
| Example 3 | 0.85/1.19 | ○ | ○ | ○ |
| Example 4 | 0.87/1.25 | ○ | ○ | ○ |
| Example 5 | 0.83/1.23 | ○ | ○ | ○ |
| Example 6 | 0.85/1.23 | ○ | ○ | ○ |
| Example 7 | 0.88/1.30 | ○ | Δ | Δ |
| Example 8 | /1.25 | ○ | ○ | ○ |
| Example 9 | /1.22 | ○ | ○ | ○ |
| Example 10 | /1.27 | ○ | ○ | ○ |
| Example 11 | /1.25 | ○ | ○ | ○ |
| Example 12 | /1.17 | Δ | Δ | ○ |
| Example 13 | /1.29 | ○ | ○ | ○ |
| Comparative Example 1 | 0.70/1.19 | ○ | X | X |
| Comparative Example 2 | 0.72/1.10 | X | ○ | X |
| Comparative Example 3 | 0.85/1.29 | X | X | X |

In color developing sensitivity (1)/(2), (1) shows the date measured by 0.25 mJ/dot and (2) shows the date measured by 0.34 mJ/dot.

INDUSTRIAL APPLICABILITY

The thermally sensitive recording medium of the present invention is characterized in that the strength of a thermally sensitive recording layer is improved, it has a good water-resistance, printing aptitude and heat resistance of a recorded image. Further, the accumulation of dregs on a head is not observed and it is good at printing runnability and seal putting ability. That is, the effect for actual use is excellent.

The invention claimed is:

1. A thermally sensitive recording medium comprising a thermally sensitive color developing layer formed on a substrate, the thermally sensitive color developing layer comprising a colorless or pale-colored basic leuco dye and a color developing agent as main components, and further comprising an acrylic polymer, said acrylic polymer being obtained by copolymerizing an acryl acrylate, an alkyl methacrylate and a vinyl silane, and a colloidal silica possessing a chain structure, as separate entities, the content of the colloidal silica being 10-300 weight parts to 100 weight parts of the acrylic polymer.

2. The thermally sensitive recording medium of claim 1, wherein the acrylic polymer comprises acrylonitrile as a monomer component.

3. The thermally sensitive recording medium of claim 1, wherein the acrylic polymer comprises styrene as a monomer component.

4. The thermally sensitive recording medium of claim 1, wherein the colloidal silica consists of spherical colloidal silica particles of an average particle size of 10-50 nm and a metal oxide containing silica which bonds the spherical colloidal silica particles and D1/D2 is 3 or more, wherein D1 is the particle size as measured by dynamic light scattering method and is 50-500 nm and D2 is the average particle size of spherical colloidal silica in nm and is measured by a nitrogen absorbing method, and said spherical colloidal silica particles are linked in a plane.

* * * * *